United States Patent [19]

Goodman et al.

[11] Patent Number: 4,472,014

[45] Date of Patent: Sep. 18, 1984

[54] INSULATION DISPLACEMENT CONNECTOR FOR FLAT CABLE

[75] Inventors: David S. Goodman, Mission Viejo; Gerald J. Selvin, Huntington Beach; Robert D. Malucci, Mission Viejo, all of Calif.

[73] Assignee: International Telephone & Telegrah Corporation, New York, N.Y.

[21] Appl. No.: 423,854

[22] Filed: Sep. 27, 1982

[51] Int. Cl.[3] ..... H01R 13/39

[52] U.S. Cl. ..... 339/99 R

[58] Field of Search ..... 339/97 R, 97 P, 98, 339/99 R

[56] References Cited

U.S. PATENT DOCUMENTS 3,027,536 3/1962 Pasternak ..... 339/97 R
4,089,580 5/1978 Huffnagle et al. ..... 339/99 R
4,169,646 10/1979 Stape et al. ..... 339/99 R
4,190,952 3/1980 Thomas et al. ..... 339/99 R

*Primary Examiner*—Joseph H. McGlynn
*Attorney, Agent, or Firm*—T. E. Kristofferson; T. L. Peterson

[57] ABSTRACT

An insulation displacement connector is disclosed which is particularly adapted for use with flat cable having closely spaced conductors. The termination end of each contact in the connector is partially bent about a vertical axis providing an intermediate curved portion and a pair of elongated side edges. The side edges of each contact engage a conductor of the cable at two longitudinally spaced locations thereon while the intermediate curved portion of the contact, which is preferably coated with an insulation material, supports the adjacent conductor of the cable.

8 Claims, 13 Drawing Figures

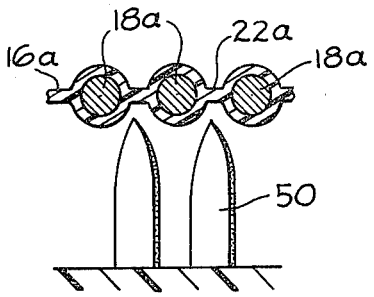
FIG. 8
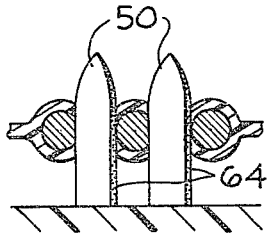
FIG. 9
FIG. 10
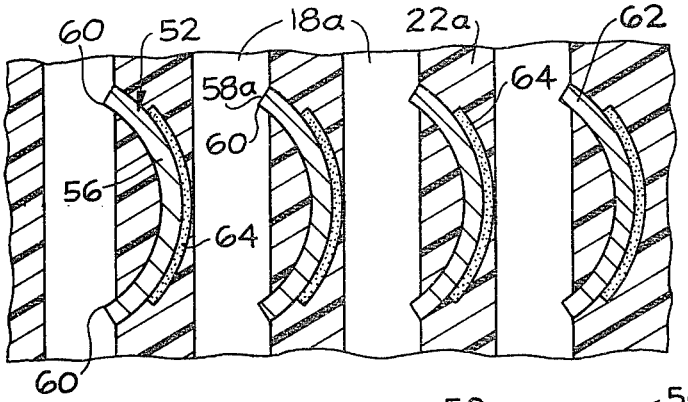
FIG. 11
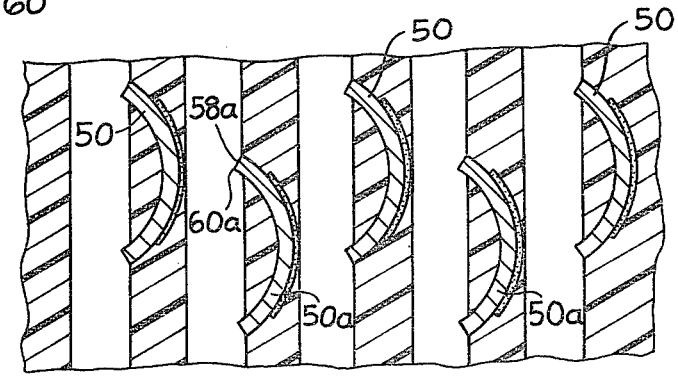
FIG. 13
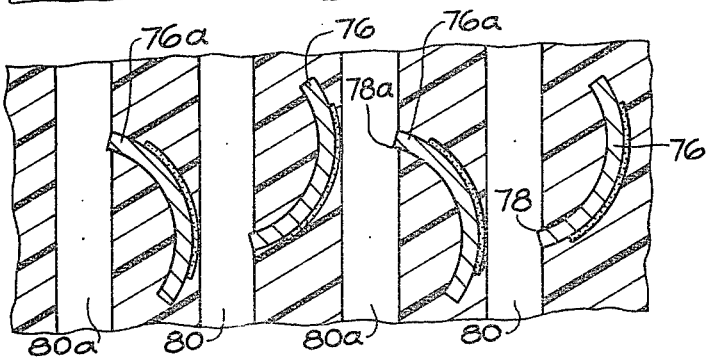

INSULATION DISPLACEMENT CONNECTOR FOR FLAT CABLE

BACKGROUND OF THE INVENTION

The present invention relates generally to an electrical connector and, more particularly, to an insulation displacement connector for flat cables.

Mass termination techniques utilizing insulation displacement connectors have been commonplace throughout the industry. Such techniques allow rapid interconnections to be made between the conductors of a flat cable and the contacts of the connector by simply clamping the cable between the connector cap and housing thereby forcing the cable conductors into slots in the contacts. Generally, the termination end of the contacts are in the form of slotted plates or slotted barrels. U.S. Pat. No. 4,260,212 shows a slotted plate insulation displacement contact which is partially coated with an insulation material. U.S. Pat. No. 4,039,240 discloses a slotted barrel type of insulation displacement contact. The slotting in the contacts produces what might be considered to be a double tine terminating system in which each tine of the slotted contact is located on opposite sides of the cable conductor. It will be appreciated that because of the double tine system there is a limitation on the closeness of the spacing of the conductors of the flat cables and, therefore, miniaturization of the cable/connector assembly.

It is the object of the present invention to provide a unique installation displacement contact which does not utilize the double tine terminating system and therefore allows termination of a connector to a flat cable having more closely spaced conductors.

SUMMARY OF THE INVENTION

According to the principal aspect of the present invention, there is provided an insulation displacement contact in which the termination end embodies only a single tine which electrically engages a conductor of a flat cable on just one side thereof. More specifically, the termination section of the contact of the present invention is preferably partially bent about a vertical axis providing an intermediate bent portion and a pair of elongated side edges. In the preferred embodiment of the invention, the side edges electrically engage the conductor of a flat cable at two longitudinally spaced locations thereof when the flat cable is pushed downwardly over the rear of the contact body. Preferably, the outer surface of the bent portion of the contact body is coated with an insulation material to assure electrical isolation between adjacent conductors of the flat cable. A plurality of the contacts are arranged in a row in a connector body in such a fashion that the intermediate portion of each contact supports a conductor of fhe flat cable which is electrically engaged by the side edges of the next adjacent contact. Thus, the termination end of the contact of the present invention forms a single tine system for engaging a conductor on a flat cable, and also serves the function of supporting a second conductor which is electrically engaged by an additional contact. By this arrangem:ent, an insulation displacement connector is provided which may engage flat cable conductors having closer spacing than which has been practical heretobefore. The connector may also be used with a plurality of generally parallel discrete wires.

BRIEF DESCRIPTION OF THE DRAWINGS

FIG. 8 is a view similar to FIG. 3 showing a closely spaced conductor flat cable positioned over a pair of contacts of the present invention as illustrated in FIGS. 5 to 7;

FIG. 9 shows the flat cable of FIG. 8 terminated to the contacts of the invention;

FIG. 10 is a horizontal sectional view through four contacts of the invention terminated to a flat cable, wherein the contacts are mounted in a straight row;

FIG. 11 is a sectional view similar to FIG. 10 showing a staggered row of contacts of the present invention;

FIG. 13 is a sectional view similar to FIGS. 10 and 11 showing still a further alternative form of the contact of the present invention terminated to the conductors of a flat cable.

DESCRIPTION OF THE PREFERRED EMBODIMENTS

Figure 1:
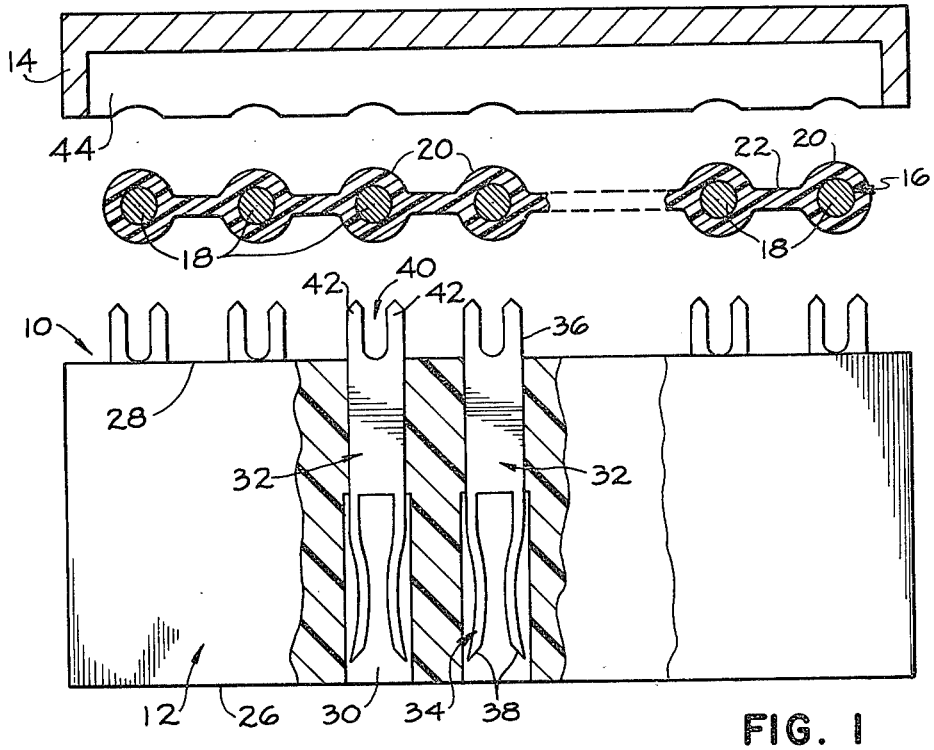
FIG. 1 PRIOR ART
FIG. 1 is a partial longitudinal sectional view through a conventional prior art insulation displacement connector showing the cap separated from the housing with a flat cable position therebetween.

Reference is first made to FIGS. 1 to 4 of the drawings which illustrate a typical prior art insulation displacement connector arrangement. In FIG. 1, the prior art connector, generally designated 10, comprises an insulator housing 12 and insulator terminating cap 14. A flat cable 16 is shown positioned between the cap and the housing in FIG. 1. The cable comprises a plurality of conductors 18 each covered with an insulation layer 20. The insulated conductors are interconnected by insulation webs 22.

The housing 12 has a forward mating end 26 and a rear terminating end 28. A row of contact cavities 30 extend from the forward mating end to the rear termination end of the housing. If the flat cable 16 had twice as many conductors therein as illustrated in FIG. 1, and therefore half spacing between the conductors, a second row of contact cavities would be provided in the housing offset from the cavities 30 in the first row. In any event, the longitudinal spacing of the contact cavities corresponds generally to the spacing of the conductors of the flat cable.

A contact 32 is mounted in each cavity 30 in the connector housing. Each contact embodies a forward mating section 34 adjacent to the forward mating end 26 of the housing and a rear termination end 36 which extends rearwardly behind the end 28 of the housing, or above such end as viewed in FIG. 1. The forward mating section 34 of each contact is illustrated as comprising a pair of spring beams 38 providing a socket contact which is adapted to mate with a pin contact in a mating connector element, not shown. The forward mating section 38 of the contact might take other forms, such as a pin contact or the like. The rear termination end 36 of each contact is shown as being in the form of a flat terminal which has an axially extending slot 40 defining a pair of tines 42 that are pointed at the rear ends for piercing the webs 22 of the flat cable. The distance between the tines of each contact is less than the diameter of a conductor 18 of the flat cable so that when the conductor is pushed into the slot between the tines, the tines will pierce the insulation 20 of the cable and penetrate the conductor 18 thereby electrically and mechanically connecting the conductor to the terminal, and hence to the contact 32.

Normally the flat termination ends of the contacts are arranged in a straight row in the connector insulator and the cap 14 is formed with a longitudinally extending slot 44 which will receive the ends of the contacts when the cap is mounted over the rear of the insulator.

If the spacing of the conductors in the flat cable were half that shown in FIG. 1, the second row of contacts in the insulator referred to previously herein would embody rear termination ends which would be arranged in a straight row with individual contacts staggered relative to those in the first row so that adjacent conductors of the flat cable would be engaged by alternate contacts in the two rows when the flat cable is pushed down over the rear termination ends of the contacts. A second slot corresponding to slot 44 would be required in the cap 14 if a second row of contacts were provided.

Figure 2:
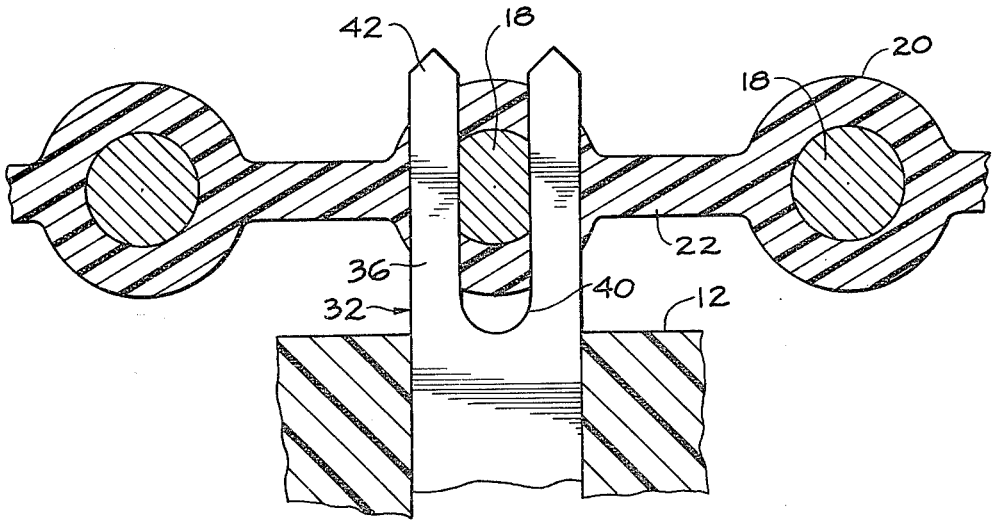
FIG. 2 PRIOR ART
FIG. 2 is an enlarged fragmentary view showing the flat cable illustrated in FIG. 1 terminated to one of the contacts of the connector.
Figure 3:
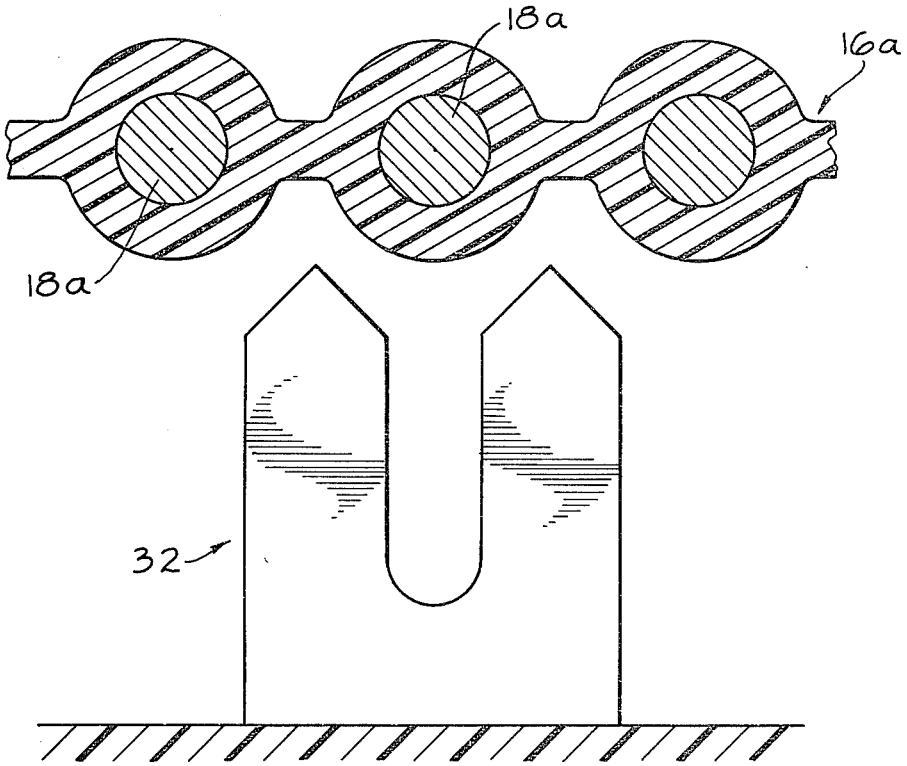
FIG. 3 PRIOR ART
FIG. 3 is a fragmentary view similar to FIG. 2 showing a flat cable having more closely spaced conductors positioned to engage a contact similar to that shown in FIG. 2.
Figure 4:
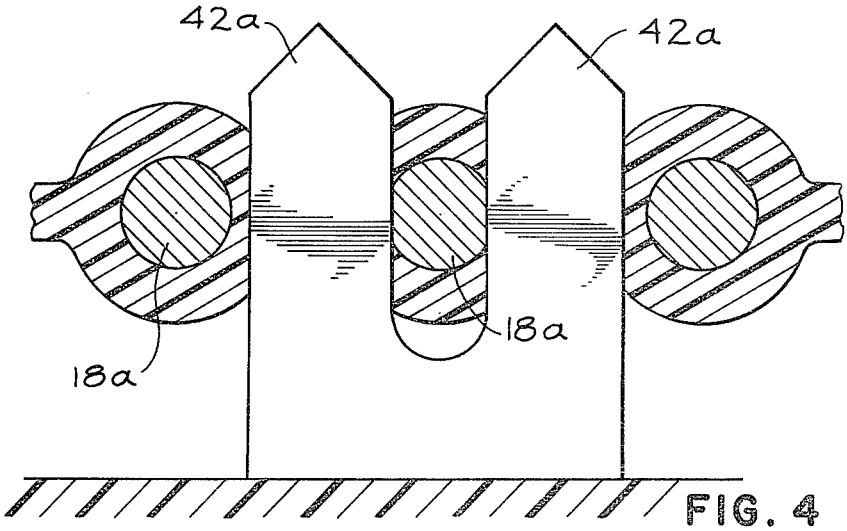
FIG. 4 PRIOR ART
FIG. 4 is a view similar to FIG. 2 showing the closely spaced conductor flat cable of FIG. 3 terminated to the contact.

The cap 14 functions as a tool for pushing the flat cable over the rear termination ends of the contacts in the connector assembly 10. FIG. 2 illustrates how one conductor 18 of the flat cable is terminated to the rear end 36 of a contact 32. Because of the substantial spacing between the conductors of the flat cable illustrated in FIGS. 1 and 2, it is seen that there is no problem in making electrical engagement between the contact 32 and one conductor 18 of the flat cable without engaging one of the other conductors. However, as seen in FIGS. 3 and 4, if a flat cable 16*a* were utilized with the conventional contact 32 having more closely spaced conductors 18*a*, when the cable is terminated to the contact it is possible that either one of the tines 42*a* of the contact may engage two adjacent conductors of the flat cable. Thus, the typical slotted contact of the prior art, which provides a double tine terminating system wherein tines are disposed on opposite sides of each conductor of the flat cable, places a considerable constraint on the spacing of the conductors in the flat cables which may be utilized with the prior installation displacement systems.

Figure 5:
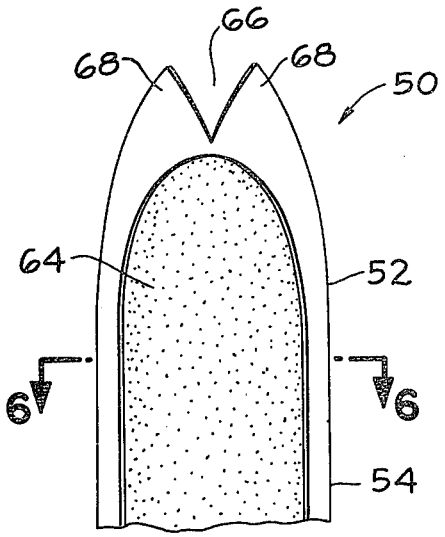
FIG. 5 is a front elevational view of the termination end of the insulation displacement contact of the present invention.
Figure 6:
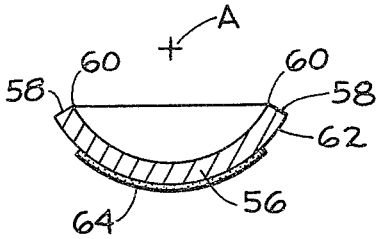
FIG. 6 is a transverse sectional view taken along line 6—6 of FIG. 5.
Figure 7:
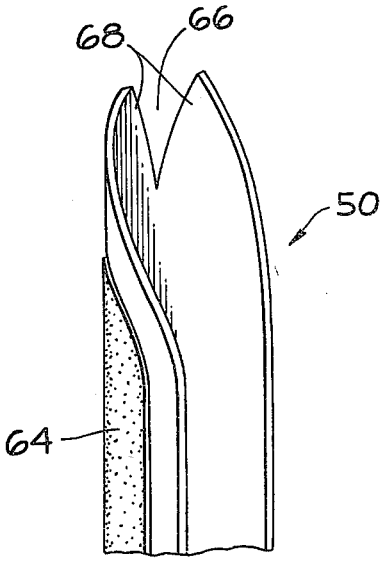
FIG. 7 is a perspective view of the contact illustrated in FIGS. 5 and 6, showing the rear and one side thereof.

According to the invention there is provided a single tine contact 50, as shown in FIGS. 5 to 7, which comprises an elongated metallic body 52 having a rear termination end 54 and a forward mating end, not shown, which may correspond to the mating end 34 of the contact 32 illustrated in FIG. 1. As best seen in FIG. 6, the contact body 52 is partially bent about an axis "A" extending lengthwise of the body providing an intermediate bent portion 56 and a pair of elongated side edges 58. Preferably the contact body is bent in the form of an arc. For example, the contact body in the region of the termination end may comprise a longitudinal section of a cylinder having an arcuate extent of less than 180°. Each side edge 58 of the contact provides a sharp corner 60 which is adapted to engage a conductor of a flat cable, while the outer surface 62 of the curved contact body is coated with an insulation material 64. The insulation may be a plastic applied by spraying or brushing, or a ceramic coating, or a metal oxide layer, or the like.

A notch 66 is formed in the upper end of the contact body providing a pair of pointed prongs 68 for piercing through the web 22 of the flat cable.

In one embodiment of the invention, as seen in FIG. 10, the contacts are mounted in a straight row in a connector insulator, similar to the contacts 32 illustrated in FIG. 1. The coated outer surfaces 62 of the contacts all face in one direction. The spacing lengthwise of the row between the side edges of one contact and the curved outer surface of the next adjacent contact is slightly less than the cross-section of the cable conductor 18*a* therebetween. Thus, when the flat cable 229 having relatively closely spaced conductors 18*a* therein is pushed down over the row of contacts, the pointed prongs 68 of the contacts will pierce through the webs 22*a* of the cable and the conductors 18*a* of the cable will be forced downwardly through the spaces between the adjacent contacts as seen in FIGS. 9 and 10, whereupon the sharp corners 60 of each contact will displace the insulation surrounding the conductor 18*a*, and penetrate the conductor at two longitudinally spaced locations thereby providing electrical engagement between the contact and the conductor at two positions. The insulation coating 64 on the outer surface of the contact electrically isolates the metallic body 52 from the next adjacent conductor 18*a* of the flat cable thereby assuring that the conductors of the flat cable will remain insulated from each other.

It will be appreciated that the intermediate bent portion 56 of each contact provides mechanical support for the cable conductor 18*a* positioned adjacent thereto so that the sharp corners 60 on the contact on the opposite side of the conductor may penetrate the conductor to make good electrical engagement herewith. Thus, the double tine contact approach of the prior art insulation displacement contacts is avoided by the present invention by utilizing a curved single tine configuration and by relying upon the adjacent contacts for providing the mechanical support to the flat cable conductors to make electrical engagement therewith. As a result, a substantially narrower contact termination end is provided which permits the use of the contacts of the present invention with flat cables having substantially closer spacing of the conductors than is possible with the prior art contacts.

Reference is now made to FIG. 11 which shows an alternative embodiment of the invention in which alternate contacts 50*a* are offset laterally from the adjacent contacts 50 to provide a staggered row of contacts. In this arrangement, the side edge 58*a* of each alternate, offset contact is generally aligned with the center of the next adjacent contact 50 thereby providing greater support for the cable conductor at the location of the sharp corners 60*a* of the contact 50*a*. In either of the embodiments illustrated in FIGS. 10 and 11, two rows of contacts may be provided for engaging conductors of a flat cable having even closer spacing than that illustrated in FIGS. 10 and 11, as described previously herein in connection with the prior art connector illustrated in FIG. 1.

Figure 12:
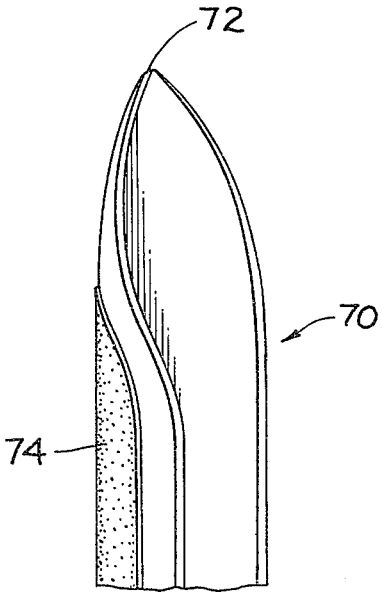
FIG. 12 is a perspective view showing an alternative form of the contact of the present invention which has a cross-section as illustrated in FIG. 6.

FIG. 12 shows a modified form of the contact of the present invention, generally designated 70, which has a crosssection similar to that shown in FIG. 6, but has only a single pointed upper end or prong 72. The contact 70 is formed with an insulation coating 74 on its outer surface similar to the coating 64 for the contact 50.

FIG. 13 illustrates still a further embodiment of the invention in which the contacts 76 have an arcuate extent of only about 90° so that only one of the side edges 78 thereof engages a cable conductor 80. In this arrangement, alternate contacts 76*a* are disposed at an angle relative to the contacts 76 so that the body of the contact 76*a* will support the cable conductor 80 on the side opposite to the side that the edge 78 of the contact 76 engages the conductor. Likewise, the side edge 78*a* of each contact 76*a* engages a cable conductor 80*a* at a point opposite to where the next adjacent contact 76 supports the conductor. In this arrangement, it will be seen that the contacts engage their respective conductors at only one point, rather than at two longitudinally spaced points as shown in FIGS. 10 and 11.

What is claimed is:

1. An electrical connector for a plurality of generally parallel conductors covered by insulation comprising:
   an insulator;
   a plurality of contacts mounted in a row in said insulator spaced apart a distance corresponding to the spacing of said conductors, each said contact having a termination end extending outwardly from a surface of said insulator;
   the termination end of each said contact being only partially bent about an axis perpendicular to said surface providing an intermediate bent portion and a pair of elongated side edges;
   said bent portions of at least some of said contacts facing in the same direction in said row;
   said side edges of each said contact being shaped to displace said insulation and engage a respective conductor at two longitudinally spaced locations when the conductors are pushed downwardly between said rear termination ends of said contacts; and
   alternate contacts in said row being offset laterally to provide a staggered row of contacts, one side edge of each said offset contact being generally aligned with the bent portion of the next adjacent contacts.

2. An electrical connector as set forth in claim 1 including:
   an insulation coating on the outer surface of the bent portion of each said contact for assuring electrical isolation of adjacent conductors.

3. An electrical connector as set forth in claim 1 wherein:
   said bent portion of each said contact has an arcuate configuration and said side edges are defined by sharp corners.

4. An electrical connector cable assembly comprising:
   an insulator;
   a plurality of contacts mounted in a row in said insulator, each said contact having a termination end extending outwardly from a surface of said insulator;
   a flat cable having a plurality of parallel conductors covered by insulation;
   said flat cable being mounted over said termination ends of said contacts with its conductors extending perpendicular to said row and with individual conductors lying between adjacent contacts;
   the termination end of each said contact having a bowed configuration in transverse section providing a pair of elongated side edges and an intermediate bent portion, said bent portions of said contacts all facing in the same direction in said row;
   at least one of said side edges of each said contact displacing insulation of said flat cable and engaging a respective conductor thereof on one side of said conductor;
   an insulation coating on the outer surface of the bent portion of each said contact for assuring electrical isolation of adjacent conductors of said cable; and
   the spacing lengthwise of said row between said one side edge of one contact and the outer surface of the bent portion of the next adjacent contact being slightly less than the cross-section of the cable conductor therebetween whereby said bent portion engages and laterally supports said conductor.

5. An assembly as set forth in claim 4 wherein:
   both side edges of each said contact engages a respective conductor of said flat cable.

6. An assembly as set forth in claim 4 wherein:
   alternate contacts in said row are offset laterally to provide a staggered row of contacts, said one side edge of each said offset contact being generally aligned with the bent portion of the next adjacent contacts.

7. An assembly as set forth in claim 4 wherein:
   the termination end of each said contact comprises a single tine.

8. An electrical connector for a plurality of generally parallel conductors covered by insulation comprising:
   an insulator;
   a plurality of contacts mounted in a row in said insulator spaced apart a distance corresponding to the spacing of said conductors, each said contact having a termination end extending outwardly from a surface of said insulator;
   the termination end of each said contact being only partially bent about an axis perpendicular to said surface providing an intermediate bent portion and a pair of elongated side edges;
   said bent portions of at least some of said contacts facing in the same direction in said row;
   one of said side edges of each said contact being shaped to displace said insulation and engage said conductor when the conductors are pushed downwardly between said rear termination ends of said contacts; and
   alternate contacts in said row are offset laterally to provide a staggered row of contacts, said one side edge of each said offset contact being generally aligned with the bent portion of the next adjacent contacts.

* * * * *